US007867017B1

(12) United States Patent
Chen

(10) Patent No.: US 7,867,017 B1
(45) Date of Patent: Jan. 11, 2011

(54) CONNECTOR INSERTION SENSING STRUCTURE

(75) Inventor: Po-Jung Chen, Taoyuan (TW)

(73) Assignee: U.D. Electronic Corp., Taoyuan County (TW)

( * ) Notice: Subject to any disclaimer, the term of this patent is extended or adjusted under 35 U.S.C. 154(b) by 0 days.

(21) Appl. No.: 12/623,086

(22) Filed: Nov. 20, 2009

(51) Int. Cl.
*H01R 3/00* (2006.01)

(52) U.S. Cl. ..... 439/488

(58) Field of Classification Search ..... 439/488, 439/489, 188, 607.01
See application file for complete search history.

(56) References Cited

U.S. PATENT DOCUMENTS 4,070,557 A * 1/1978 Ostapovitch ..... 200/51.1
4,438,303 A * 3/1984 Astier ..... 200/51.1
4,552,423 A * 11/1985 Swengel, Jr. ..... 439/507
4,671,599 A * 6/1987 Olsson ..... 439/188
4,744,769 A * 5/1988 Grabbe et al. ..... 439/284
5,112,238 A * 5/1992 Cizin ..... 439/188
5,244,402 A * 9/1993 Pasterchick et al. ..... 439/217
5,387,135 A * 2/1995 Shen et al. ..... 439/676
5,772,466 A * 6/1998 Morin et al. ..... 439/489
5,800,192 A * 9/1998 David et al. ..... 439/188
6,149,464 A * 11/2000 DeBauche et al. ..... 439/607.4
6,244,908 B1 * 6/2001 Hammond et al. ..... 439/676
6,350,148 B1 * 2/2002 Bartolutti et al. ..... 439/489
6,371,780 B1 * 4/2002 Aponte et al. ..... 439/188
6,394,853 B1 * 5/2002 Hammond et al. ..... 439/676
6,981,899 B1 * 1/2006 Miller et al. ..... 439/676
7,217,152 B1 * 5/2007 Xin et al. ..... 439/490
7,241,157 B2 * 7/2007 Zhuang et al. ..... 439/188
7,519,000 B2 * 4/2009 Caveney et al. ..... 370/242
7,563,102 B2 * 7/2009 Nordin et al. ..... 439/49
7,573,254 B2 * 8/2009 Cobb et al. ..... 324/66
7,658,648 B2 * 2/2010 Aekins ..... 439/620.11
2008/0299821 A1 * 12/2008 Hammond et al. ..... 439/540.1

* cited by examiner

*Primary Examiner*—T C Patel
*Assistant Examiner*—Vladimir Imas
(74) *Attorney, Agent, or Firm*—Muncy, Geissler, Olds & Lowe, PLLC

(57) ABSTRACT

A connector insertion sensing structure includes an electrically insulative housing having an insertion hole for the insertion of an external modular plug and a vertical front mounting groove located on the front wall at one lateral side of the insertion, a metal sensing terminal mounted in the vertical front mounting groove and having a contact portion suspending in the insertion hole and a bottom bonding tip for bonding to an external circuit board, and a metal shield surrounding the electrically insulative housing and having a metal actuation terminal backwardly extended from the front panel thereof and suspending in the insertion hole and movable by an inserted external modular plug to press a pressure tip thereof on the contact portion of the metal terminal in producing a signal indicative of the insertion of the external modular plug.

9 Claims, 7 Drawing Sheets

CONNECTOR INSERTION SENSING STRUCTURE

BACKGROUND OF THE INVENTION

1. Field of the Invention

The present invention relates to electric connectors and more particularly, to a connector insertion sensing structure, which comprises a metal sensing terminal mounted in the electrically insulative housing thereof and a metal actuation terminal extended from the metal shield thereof and suspending in one insertion hole of the electrically insulative housing at one side for touching the metal sensing terminal to produce a signal upon insertion of an external modular plug into the insertion hole.

2. Description of the Related Art

Following fast development of computer technology, desk computers and notebook computers are popularly used by people in different fields in our society. Advanced computers commonly have high operation speed, small size and high mobility characteristics. Further, a computer has interface means with communication ports for the connection of peripheral apparatus, such as printer, mobile memory device, hand writing pad, etc. A computer peripheral interface may be configured subject to USB, IEEE 1394 and/or other specifications. Further, the development of network communication technology brings convenience to people for communication and transmission of real-time data, advertising devices and E-mail at distance. People can also search the desired information and data from the Internet, play computer games or chat with friends on the Internet. Therefore, regular computers commonly have a network connector for connection to a computer network. A computer network connector is normally configured subject to RJ45 specifications.

The network connector of a computer is generally arranged at the rear side. If a computer is disposed under a desk, the user will not see the installation of the modular plug of the modular cable when the modular plug is being inserted into the insertion hole of the network connector. Further, when inserting the modular plug of a modular cable into the insertion hole of a network connector at one lateral side or rear side of a notebook computer, the user must move the notebook computer so that the insertion of the modular plug can be visually checked. Therefore, the arrangement of the network connector of a conventional desk computer or notebook computer does not facilitate installation of a modular cable.

There is known a network connector with a LED indicator light. When the modular plug of a modular cable is inserted into the network connector and the metal contacts of the modular plug are respectively connected to the respective metal contacts in the network connector, the LED indicator light is electrically connected to emit light, giving a visual signal indicative of the connection between the network connector and the modular cable. However, if the computer is disposed in a corner area under a desk, the user may be unable to see the light emitted by the LED indicator light in the network connector. In order to check the installation of the modular cable, the user may have to move the mainframe of the computer. Further, if the internal circuit fails, the LED indicator light will not be unable to emit light. In this case, the user cannot know the installation status of the modular cable.

Therefore, it is desirable to provide a measure that eliminates the aforesaid problems and gives an indicative signal upon accurate insertion of a modular cable.

SUMMARY OF THE INVENTION

The present invention has been accomplished under the circumstances in view. It is one object of the present invention to provide a connector insertion sensing structure, which gives an indicative signal upon accurate insertion of a modular cable.

To achieve this and other objects of the present invention, a connector insertion sensing structure comprises an electrically insulative housing, a sensing terminal mounted in a vertical front mounting groove on the front wall of the electrically insulative housing at one lateral side of at least one insertion hole of the electrically insulative housing, a metal shield surrounding the electrically insulative housing, and a metal actuation terminal extended from the front panel of the metal shield and suspending in one insertion hole of the electrically insulative housing at one lateral side adjacent to the metal sensing terminal. When the modular plug of a modular cable is inserted into the insertion hole of the electrically insulative housing to touch the metal actuation terminal, the metal actuation terminal is forced to press on the metal sensing terminal, thereby producing a signal indicative of accurate insertion of the modular plug.

DETAILED DESCRIPTION OF THE PREFERRED EMBODIMENT

Figure 1:
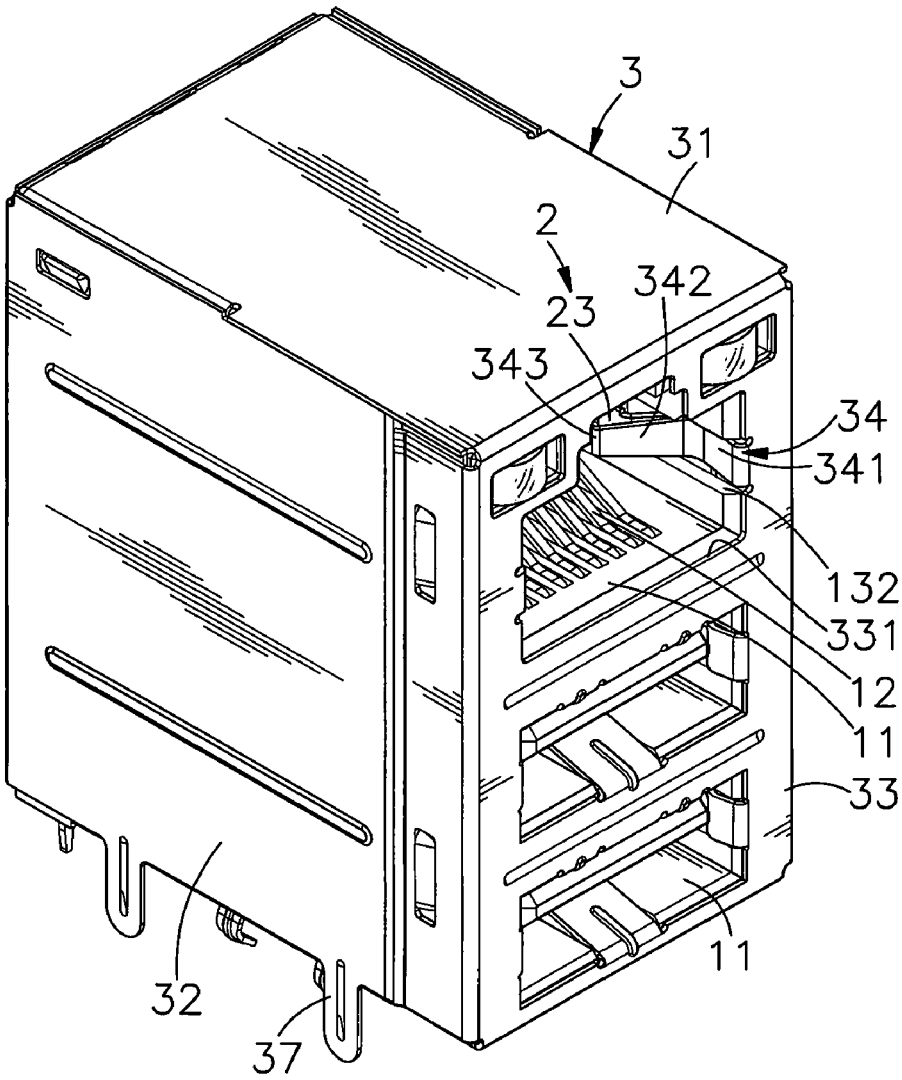
FIG. 1 is an oblique elevation of the preferred embodiment of the present invention.
Figure 2:
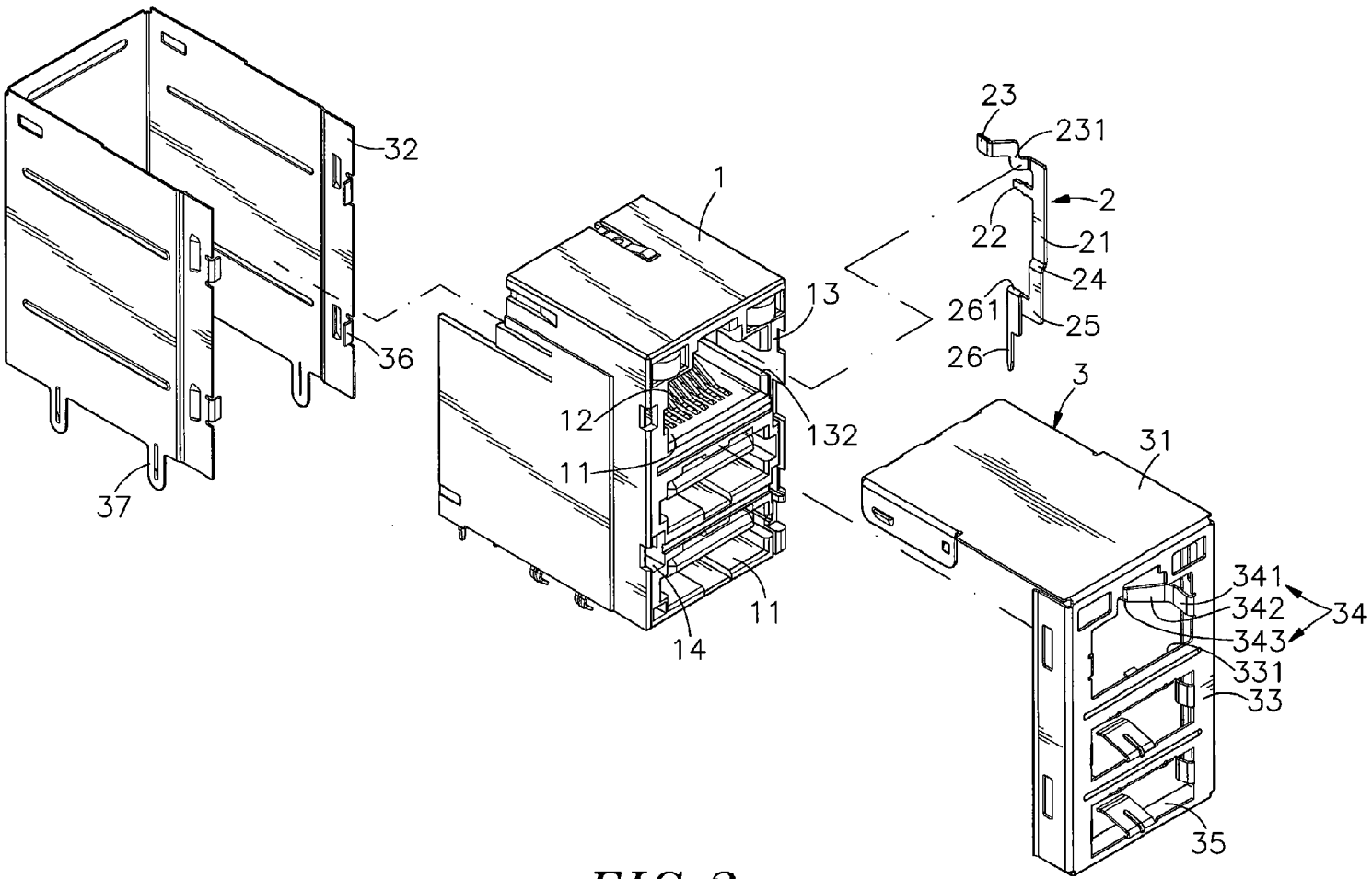
FIG. 2 is an exploded view of the preferred embodiment of the present invention.
Figure 3:
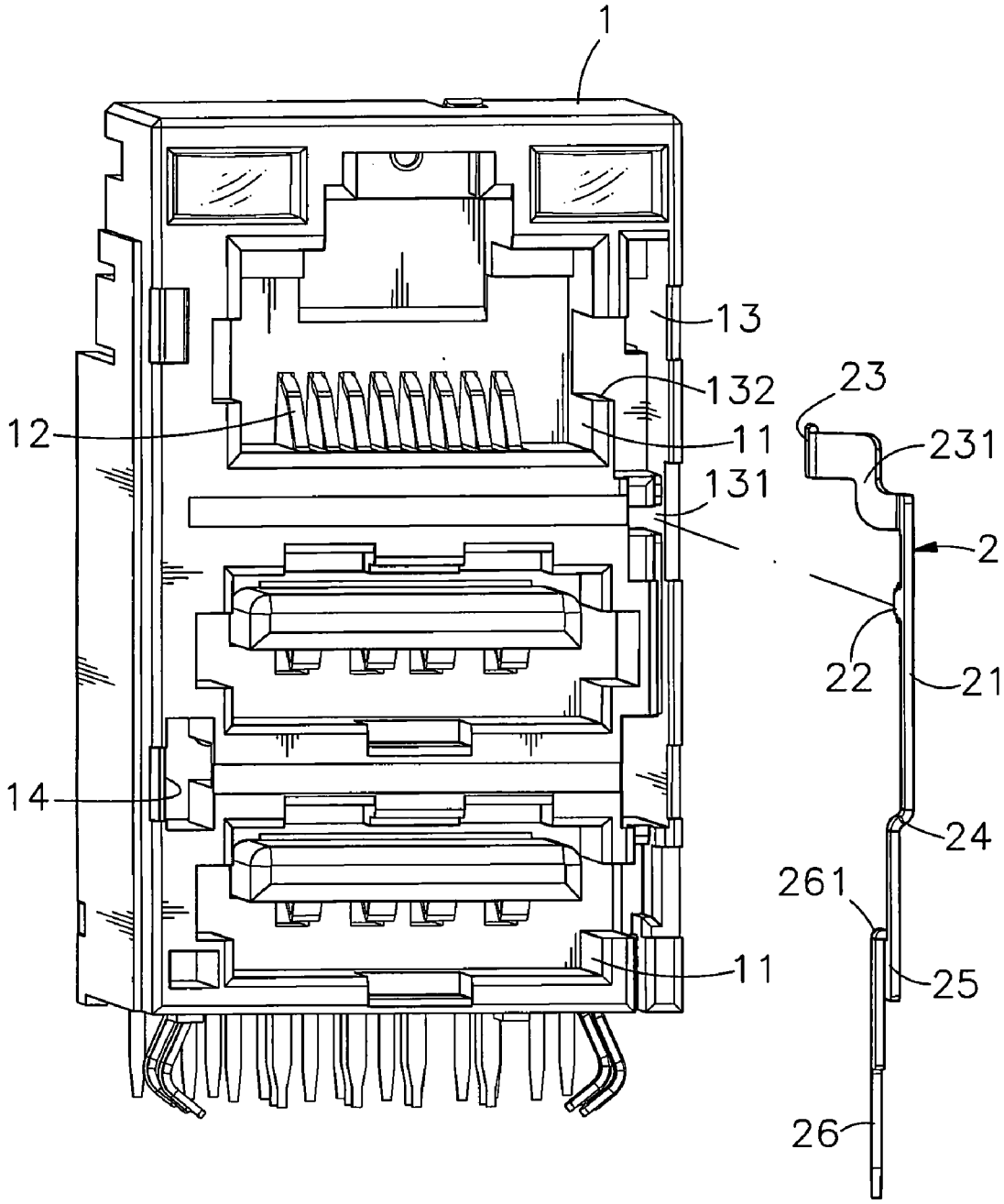
FIG. 3 is an exploded view in an enlarged scale of a part of the preferred embodiment of the present invention, showing the relationship between the electrically insulative housing and the metal sensing terminal before installation of the metal sensing terminal in the electrically insulative housing.
Figure 4:
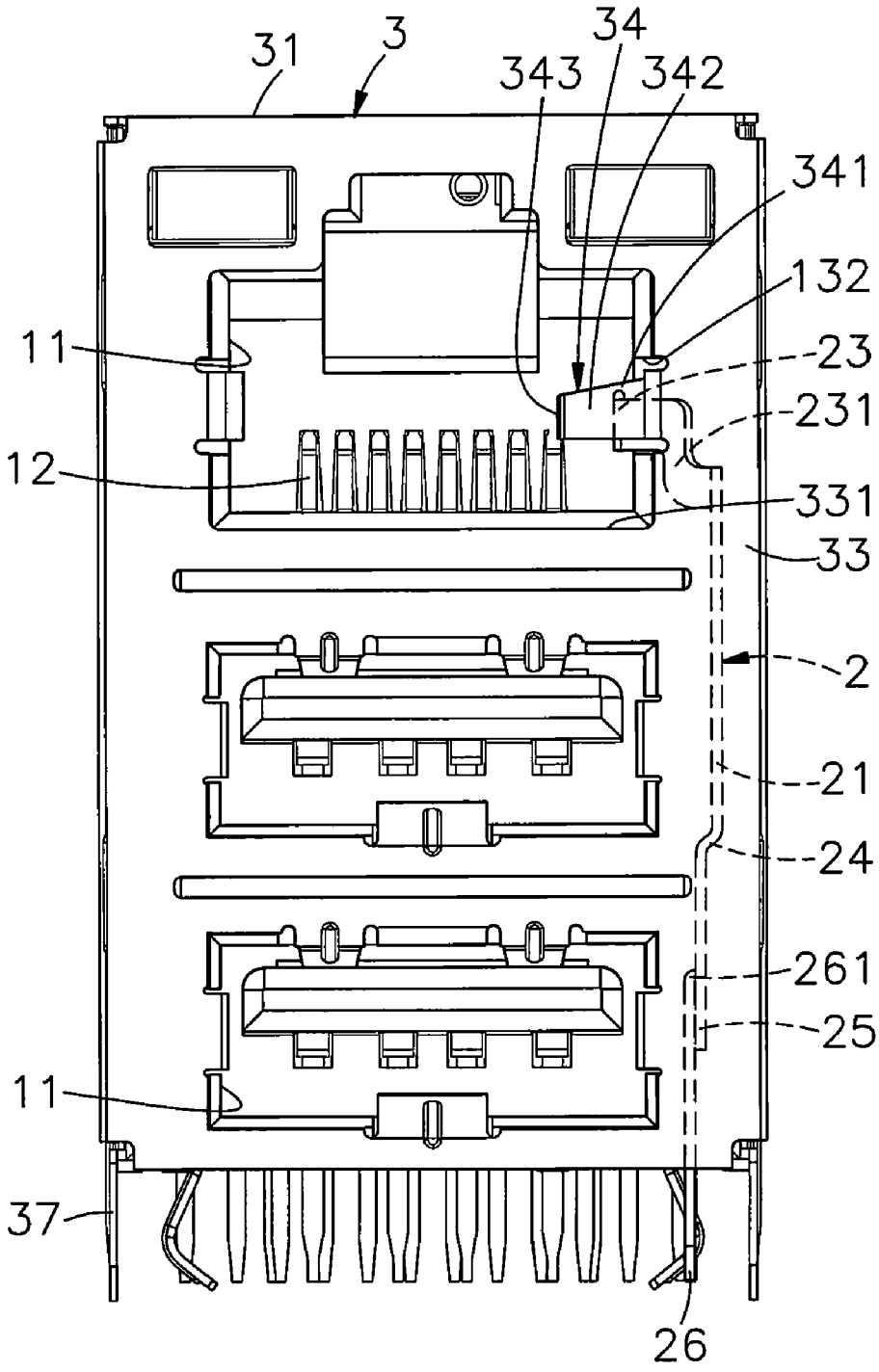
FIG. 4 is a schematic front view corresponding to FIG. 3, showing the metal sensing terminal installed in the electrically insulative housing.
Figure 5:
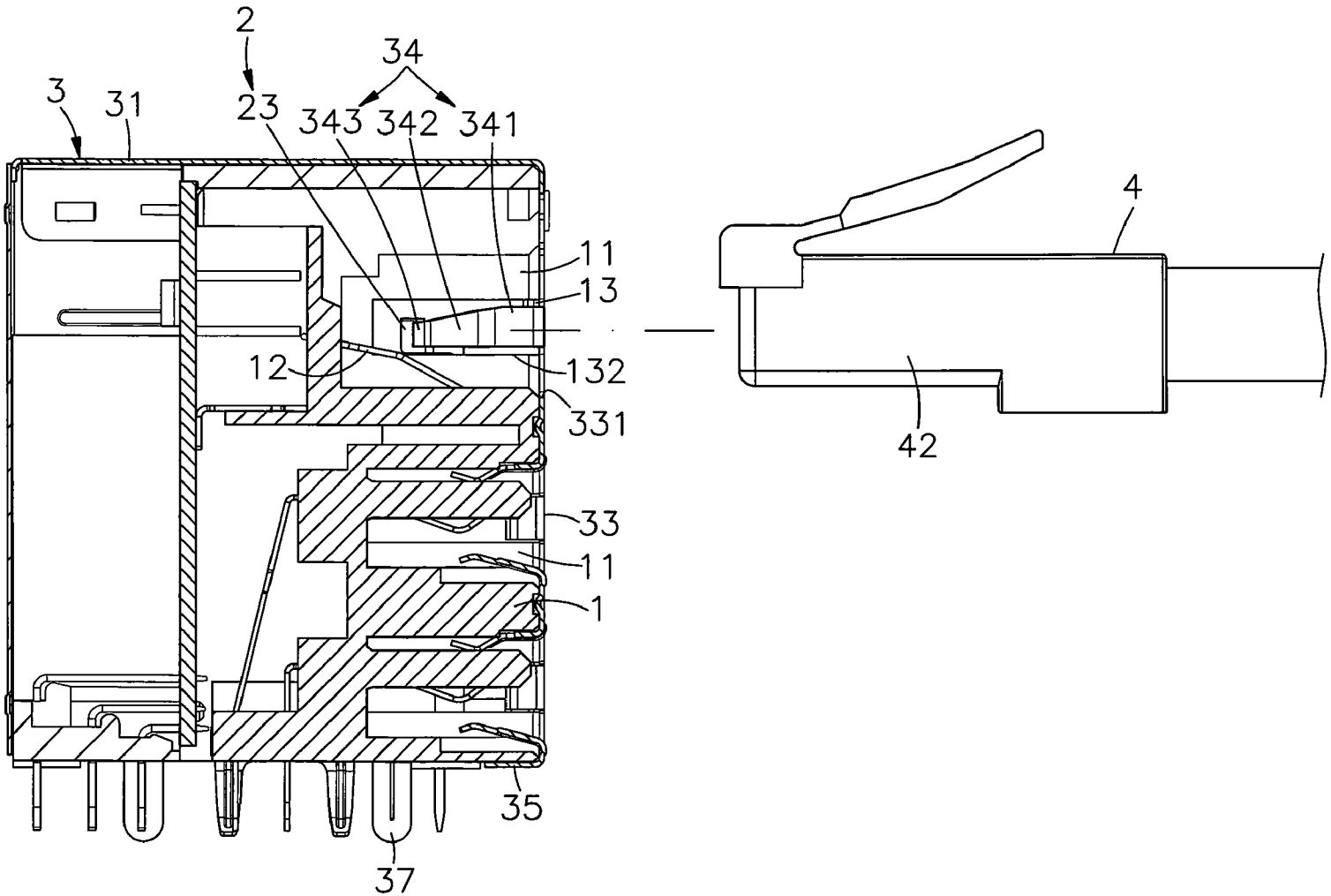
FIG. 5 is a schematic side view of the present invention before insertion of an external modular plug into the electrically insulative housing.
Figure 6:
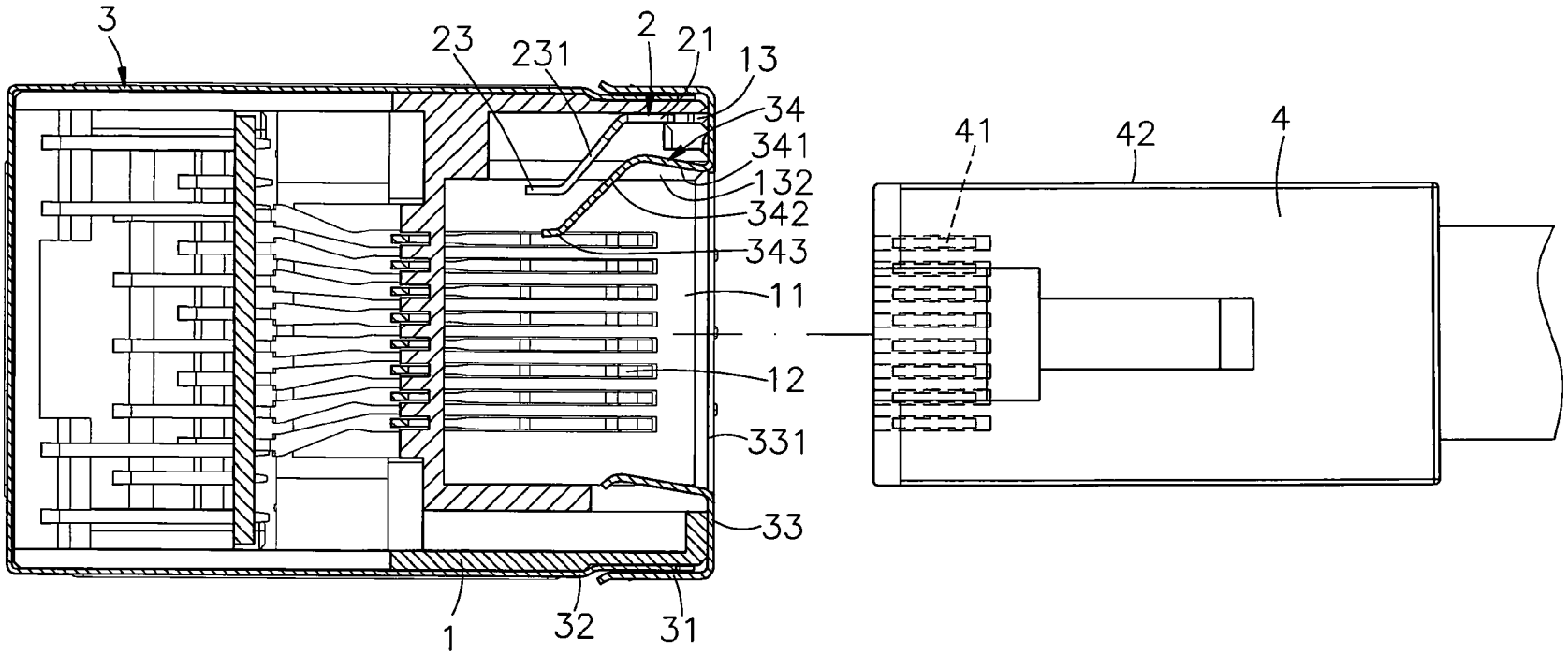
FIG. 6 is a top view of FIG. 5.
Figure 7:
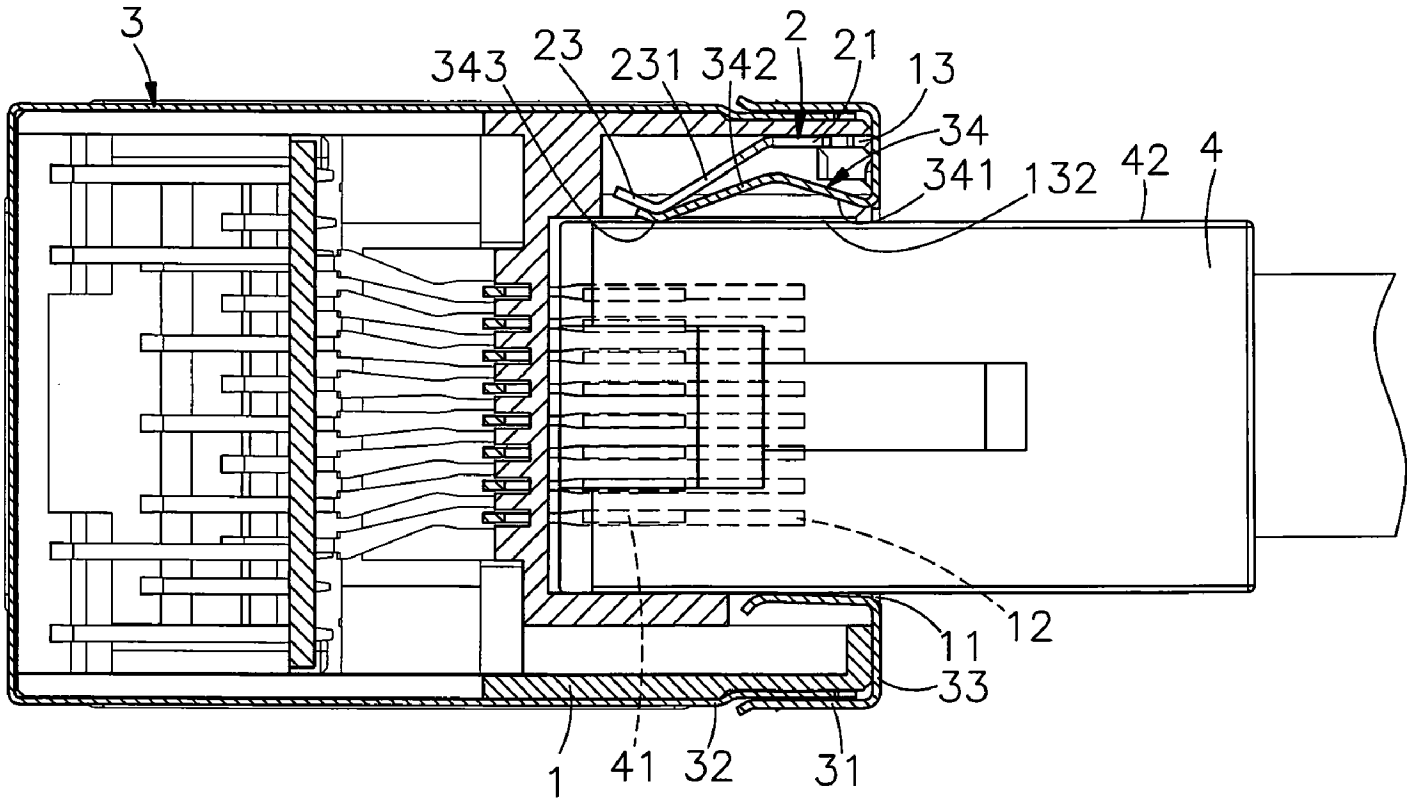
FIG. 7 corresponds to FIG. 6, showing the external modular plug inserted into the electrically insulative housing.

Referring to FIGS. 1~3, a connector insertion sensing structure in accordance with the present invention is shown comprising an electrically insulative housing 1, a metal sensing terminal 2 and a metal shield 3.

The electrically insulative housing 1 comprises at least one insertion hole 11 cut through the front wall thereof for the insertion of an external modular plug 4 individually. According to the present preferred embodiment, the electrically insulative housing 1 comprises three insertion holes 11. Each insertion hole 11 has mounted therein a set of metal contacts 12 for the contact of respective metal contacts 41 of the inserted external modular plug 4. The electrically insulative housing 1 further comprises a vertical front mounting groove 13 located on the front wall at one lateral side relative to the insertion holes 11 and vertically extending through the bottom wall, a horizontal locating hole 131 perpendicularly extended from the vertical front mounting groove 13 toward the inside of the housing 1, a horizontal locating groove 132 perpendicularly extended from the vertical front mounting groove 13 toward the inside of the housing 1 above the elevation of the horizontal locating hole 131 and a plurality of retaining notches 14 symmetrically located on the front wall at two opposite lateral sides thereof.

The metal sensing terminal 2 comprises an elongated base 21 mounted in the vertical front mounting groove 13 of the electrically insulative housing 1, a locating finger 22 perpendicularly backwardly extended from the elongated base 21 and positioned in the horizontal locating hole 131 of the electrically insulative housing 1, a contact portion 23 suspending in the top insertion hole 11, a wave-like connection portion 231 connected between the contact portion 23 and the top end of the elongated base 21 and set in the horizontal locating groove 132 of the electrically insulative housing 1, a sloping portion 24 extended from the bottom end of the elongated base 21 and sloping obliquely downwardly in a transverse direction toward the inside of one insertion hole 11 of the electrically insulative housing 1, a bonding tip 26 extending out of the bottom wall of the electrically insulative housing 1 for bonding to an external circuit board (not shown), an angled connection portion 25 extended from one end of the sloping portion 24 opposite to the elongated base 21 and a bent 261 connected between the top side of the rear end of the angled connection portion 25 remote from the sloping portion 24 and the top end of the bonding tip 26.

The metal shield 3 surrounds the electrically insulative housing 1. The metal shield 3 can be a single piece design or formed of multiple parts. According to the present preferred embodiment, the metal shield 3 is formed of a first metal shell 31 and a second metal shell 32. Further, the metal shield 3 comprises a front panel 33 covered on the front wall of the electrically insulative housing 1, a plurality of openings 331 cut through the front panel 33 corresponding to the insertion holes 11 of the electrically insulative housing 1, a bottom panel 35 perpendicularly backwardly extended from the bottom side of the front panel 33 and attached to the bottom wall of electrically insulative housing 1, a plurality of hook portions 36 symmetrically disposed at two opposite lateral sides and respectively fastened to the retaining notches 14 of the electrically insulative housing 1 and a plurality of bottom bonding legs 37 downwardly extended from the bottom side thereof for bonding to the external circuit board (not shown) to which the bottom bonding tip 26 of the metal sensing terminal 2 is bonded. Further, a metal actuation terminal 34 is formed integral with and backwardly extended from the front panel 33 at one side of one opening 331 adjacent to the vertical front mounting groove 13 of the electrically insulative housing 1. The metal actuation terminal 34 comprises a connection portion 341 extended from the front panel 33, a pressure tip 343 movable by one sidewall 42 of an inserted external modular plug 4 to press on the contact portion 23 of the metal terminal 2 and an oblique suspension portion 342 connected between the connection portion 341 and the pressure tip 343 and suspending in one insertion hole 11 of the electrically insulative housing 1 at one lateral side.

Referring to FIGS. 4 and 5 and FIGS. 1~3 again, the locating finger 22 of the metal sensing terminal 2 is positioned in the horizontal locating hole 131 of the electrically insulative housing 1 contact portion 23 of the metal sensing terminal 2 extends from the wave-like connection portion 231 out of the horizontal locating groove 132 of the electrically insulative housing 1 and suspending in one insertion hole 11 at one lateral side; the bottom bonding tip 26 extends downwardly out of the bottom wall of the electrically insulative housing 1; the metal shield 3 surrounds the electrically insulative housing 1, keeping the openings 331 in alignment with the insertion holes 11 respectively and holding the metal actuation terminal 34 in one insertion hole 11 of the electrically insulative housing 1 at one lateral side adjacent to the metal sensing terminal 2.

Further, circuit board, LEDs (light emitting diodes), filter element, terminal holder, grounding terminal and/or any of a variety of other electronic components may be mounted in the electrically insulative housing 1. Because the mounting of electronic components in the electrically insulative housing 1 is of the known art, no further detailed description in this regard is necessary.

Referring to FIGS. 6 and 7 and FIGS. 2~5 again, when inserting an external modular plug 4 into one insertion hole 11 of the electrically insulative housing 1, the front wall of the external modular plug 4 will touch the oblique suspension portion 342 of the metal actuation terminal 34, causing the oblique suspension portion 342 and connection portion 341 of the metal actuation terminal 34 to be resiliently curved. When continuously inserting the external modular plug 4 forwards, the front wall of the external modular plug 4 will be moved over the pressure tip 343 of the metal actuation terminal 34, causing the sidewall 42 of the external modular plug 4 to force the pressure tip 343 of the metal actuation terminal 34 against the contact portion 23 of the metal sensing terminal 2 in the horizontal locating groove 132 of the electrically insulative housing 1. At this time, the metal sensing terminal 2 and the metal actuation terminal 34 moved away from the insertion hole 11 of the electrically insulative housing 1 for allowing the external modular plug 4 to be inserted into the deep inside of the insertion hole 11. Because the bottom bonding legs 37 of the metal shield 3 and the bottom bonding tip 26 of the metal sensing terminal 2 are respectively electrically bonded to the same external circuit board (not shown), a signal indicative of accurate insertion of the external modular plug 4 in the respective insertion hole 11 of the electrically insulative housing 1 is produced and transmitted through the bottom bonding tip 26 to the external circuit board upon contact between the metal actuation terminal 34 and the metal sensing terminal 2.

Further, the wave-like design of the wave-like connection portion 231 enables the pressure that is applied to the contact portion 23 to be evenly distributed through the wave-like connection portion 231, enhancing the elastically deformable power of the metal sensing terminal 2 and preventing occurrence of elastic fatigue in the metal sensing terminal 2 within a short period. Further, the design of the sloping portion 24 enables the metal sensing terminal 2 to be kept away from the adjacent hook portions 36 of the metal shield 3. Further, the design of the angled connection portion 25 of the metal sensing terminal 2 enables the bottom mounting tip 26 to be kept away from the bottom panel 35 of the metal shield 3 and extended downwardly to the outside of the bottom wall of the electrically insulative housing 1 for mounting.

Further, as stated above, the bent 261 of the metal sensing terminal 2 is connected between the angled connection portion 25 and the bottom mounting tip 26. When the bottom mounting tip 26 is forced upwards (as it touched the external circuit board during installation or forced by an external body accidentally during delivery), the bent 261 will be deformed, avoiding displacement of the elongated base 21 and the contact portion 23 relative to the electrically insulative housing 1 and the metal shield 3 and allowing positive contact of the metal sensing terminal 2 by the metal actuation terminal 34 of the metal shield 3.

Further, the electrically insulative housing 1 can be made having one single insertion hole 11 of RJ type. Alternatively, the electrically insulative housing 1 can be made having multiple insertion holes 11 including one insertion hole of RJ type and one or a number of insertion holes of USB type, HDMI type or E-SATA type. The RJ type insertion hole can be disposed at the top or bottom side relative to the other insertion holes of USB type, HDMI type or E-SATA type. The set of metal contacts 12 in each insertion hole 11 is configured subject to the RJ type, USB type, HDMI type or E-SATA type of the associating insertion hole 11. Further, the horizontal locating groove 132 is formed in the RJ type insertion hole 11 at one lateral side, and the metal actuation terminal 34 of the metal shield 3 is inserted into the inside of the RJ type insertion hole 11 and suspending adjacent to the contact portion 23 of the metal sensing terminal 2. When an external RJ type modular plug 4 is inserted into the RJ type insertion hole 11 of the electrically insulative housing 1, the metal contacts 41 of the inserted RJ type modular plug 4 touch the respective metal contacts 12 in the RJ type insertion hole 11 for signal transmission, enabling the user to know accurate insertion of the RJ type modular plug 4. If the internal circuit in the electrically insulative housing 1 fails, the insertion of an external RJ type modular plug 4 into the RJ type insertion hole 11 causes the metal actuation terminal 34 of the metal shield 3 to touch the metal sensing terminal 2 in producing a signal to the circuit board (not shown) to which the bottom bonding legs 37 of the metal shield 3 and the bottom bonding tip 26 of the metal sensing terminal 2 are respectively electrically connected, indicating accurate insertion of the RJ type modular plug 4 in the RJ type insertion hole 11. Thus, the user can immediately get the message and check the failure of the internal circuit in the electrically insulative housing 1.

In conclusion, an electric connector constructed according to the present invention comprises a metal sensing terminal 2 mounted in a vertical front mounting groove 13 in the front wall of the electrically insulative housing 1 thereof at one lateral side of the at least one insertion hole 11 of the electrically insulative housing 1 and a metal actuation terminal 34 disposed at one lateral side of one opening 331 on the front panel 33 of a metal shield 3 thereof that surrounds the electrically insulative housing 1. When an external modular plug 4 is inserted through the opening 331 on the front panel 33 of the metal shield 3 into one insertion hole 11, the metal actuation terminal 34 will be forced to touch the metal sensing terminal 2, thereby causing a signal to be produced indicative of the insertion of the modular plug 4.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A connector insertion sensing structure, comprising:

an electrically insulative housing, said electrically insulative housing comprising a front wall, a bottom wall, at least one insertion hole cut through said front wall for the insertion of an external modular plug individually, each said insertion hole having mounted therein a set of metal contacts for the contact of respective metal contacts of an external modular plug inserted therein, a vertical front mounting groove located on said front wall at one lateral side relative to said at least one insertion hole and vertically extending through said bottom wall, a horizontal locating groove perpendicularly extended from said vertical front mounting groove toward the inside of said electrically insulative housing and a plurality of retaining notches bilaterally located on the front wall thereof; said metal shield comprises a plurality of hook portions respectively hooked in said retaining notches of said electrically insulative housing; said metal sensing terminal further comprises a sloping portion extended from the bottom end of said elongated base and sloping obliquely downwardly in a transverse direction toward the inside of one said insertion hole of said electrically insulative housing and connected to said bonding tip to hold said bottom bonding tip away from one said hook portion of said metal shield;

a metal sensing terminal, said metal sensing terminal comprising an elongated base mounted in said vertical front mounting groove of said electrically insulative housing, said elongated base having a top end and a bottom end opposite to said top end, a contact portion connected to the top end of said elongated base and extending through said horizontal locating groove into the corresponding insertion hole of said electrically insulative housing and a bottom bonding tip connected to the bottom end of said elongated base and extending out of the bottom wall of said electrically insulative housing for bonding to an external circuit board; and a metal shield surrounding said electrically insulative housing, said metal shield comprising a front panel covered on the front wall of said electrically insulative housing, at least one opening cut through said front panel corresponding to said at least one insertion hole of said electrically insulative housing and a metal actuation terminal backwardly extended from said front panel at one lateral side of one said opening adjacent to said vertical front mounting groove of said electrically insulative housing for pressing said metal sensing terminal to produce an electrical signal upon insertion of an external modular plug into the respective opening of said metal shield and the corresponding insertion hole of said electrically insulative housing, said metal actuation terminal comprising a connection portion extended from said front panel, a pressure tip movable by an inserted external modular plug to press on said contact portion of said metal terminal and an oblique suspension portion connected between said connection portion and said pressure tip.

2. The connector insertion sensing structure as claimed in claim 1, wherein said electrically insulative housing further comprises a horizontal locating hole perpendicularly backwardly extended from said vertical front mounting groove toward the inside of said electrically insulative housing; said metal sensing terminal further comprises a locating finger perpendicularly backwardly extended from said elongated base and positioned in said horizontal locating hole of said electrically insulative housing.

3. The connector insertion sensing structure as claimed in claim 1, wherein said metal shield further comprises a bottom panel backwardly extended from a bottom side of said front panel and attached to the bottom wall of said electrically insulative housing; said metal sensing terminal further comprises an angled connection portion connected between said sloping portion and said bonding tip to keep said bonding tip away from said bottom panel of said metal shield.

4. The connector insertion sensing structure as claimed in claim 3, wherein said metal sensing terminal further comprises a bent connected between a rear top side of said angled connection portion remote from said sloping portion and a top side of said bonding tip.

5. The connector insertion sensing structure as claimed in claim 1, wherein said metal sensing terminal further comprises a wave-like connection portion connected between said contact portion and the top end of said elongated base.

6. The connector insertion sensing structure as claimed in claim 1, wherein said metal shield is comprised of a first metal shell and a second metal shell.

7. The connector insertion sensing structure as claimed in claim 1, wherein one said insertion hole of said electrically insulative housing is a RJ type insertion hole; said horizontal locating groove is disposed in said RJ type insertion hole at one lateral side.

8. The connector insertion sensing structure as claimed in claim 1, wherein said at least one insertion hole of said electrically insulative housing includes one RJ type insertion hole and a plurality of USB type insertion holes arranged at different elevations below said RJ type insertion hole; said horizontal locating groove is disposed in said RJ type insertion hole at one lateral side.

9. The connector insertion sensing structure as claimed in claim 1, wherein said metal shield comprises a plurality of bottom bonding legs for bonding to an external circuit board.

* * * * *